US006050591A

United States Patent [19]

Bardin et al.

[11] Patent Number: 6,050,591

[45] Date of Patent: Apr. 18, 2000

[54] LONGITUDINALLY ADJUSTABLE MOUNTING FOR A SKI BINDING

[75] Inventors: Roland Bardin, Varennes Vauzelles; Michel Thevenet, Coulanges les Nevers, both of France

[73] Assignee: Look Fixations S.A., Nevers, France

[21] Appl. No.: 09/051,100

[22] PCT Filed: Oct. 4, 1996

[86] PCT No.: PCT/IB96/01058

§ 371 Date: Apr. 1, 1998

§ 102(e) Date: Apr. 1, 1998

[87] PCT Pub. No.: WO97/13560

PCT Pub. Date: Apr. 17, 1997

[30] Foreign Application Priority Data

Oct. 10, 1995 [FR] France ..... 95 12111

[51] Int. Cl.[7] ..... A63C 9/081

[52] U.S. Cl. ..... 280/633; 280/634; 280/636

[58] Field of Search ..... 280/611, 613, 280/617, 632, 633, 634, 636; 441/70, 618

[56] References Cited

U.S. PATENT DOCUMENTS

| | | | |
|---|---|---|---|
| 3,913,931 | 10/1975 | Kratky | 280/633 X |
| 3,989,274 | 11/1976 | Weigl et al. | 280/634 |
| 4,022,493 | 5/1977 | Weigl et al. | 280/633 |
| 4,506,905 | 3/1985 | Krob et al. | 280/633 |
| 4,817,981 | 4/1989 | Desbiolles et al. | 280/633 |
| 5,348,335 | 9/1994 | Dasarmaux et al. | 280/633 |
| 5,732,968 | 3/1998 | Wladar et al. | 280/633 |

*Primary Examiner*—Lanna Mai
*Assistant Examiner*—Ruth Ilan
*Attorney, Agent, or Firm*—Bugnion S.A.; John Moetteli

[57] ABSTRACT

A mounting for a ski binding including a runner (1) attached to the ski and a plate (2) slidably mounted on the runner and provided with a latch (3) that may be released by means of a lever (6) pivotably mounted under the plate (2) and extending through an aperture (10) therein. The lever and/or the plate are provided with an aperture sealing means for at least approximately sealing said aperture at least when the binding is in its operative position. The sealing means consists of, e.g., a rigid portion (11) and a flexible portion (13) of the lever.

8 Claims, 3 Drawing Sheets

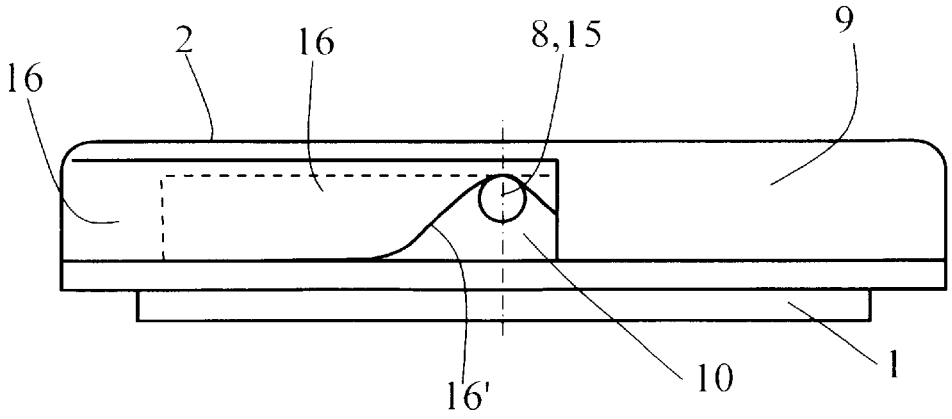
Fig.6A
Fig.6B
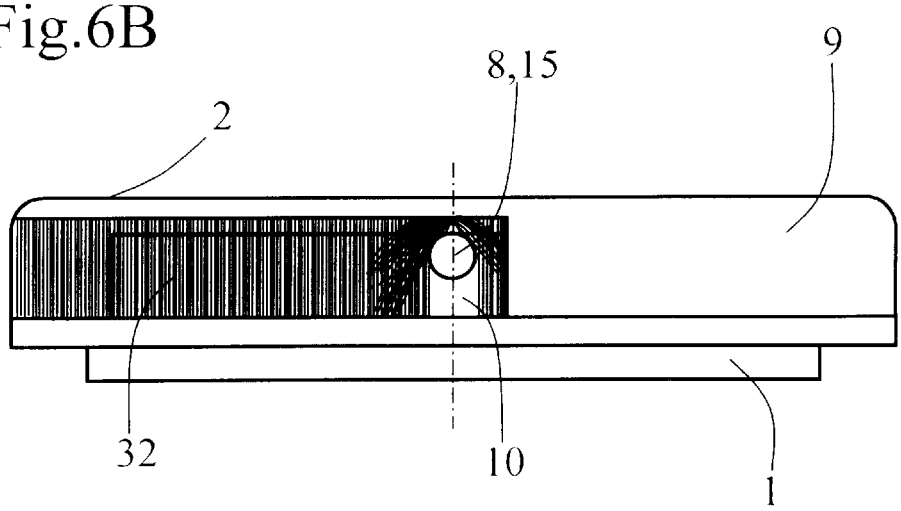
Fig.6C
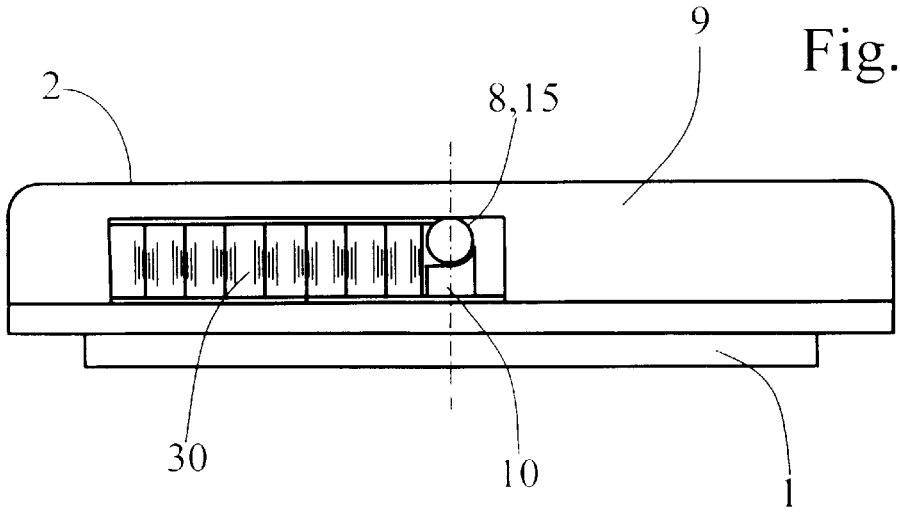

LONGITUDINALLY ADJUSTABLE MOUNTING FOR A SKI BINDING

The subject of the present invention is a longitudinally adjustable mounting for a ski binding which comprises a runner, fastened to the ski and having a row of notches parallel to the axis of the runner, and a plate slideably mounted on the runner and bearing a latch engaged, under the action of a spring, in at least one notch of the runner so as to immobilize the plate on the runner, this plate being provided with a releasing lever mounted so as to pivot, under the plate, about a pin perpendicular to the plate and passing through the plate via an aperture so as to have one end accessible for operating the lever.

Such mountings are used for top-of-the-range demonstration skis and skis for hiring. For top-of-the-range skis, it is important that the middle of the boot occupies a defined position on the ski, whatever the size of the boot. For this purpose, the front binding and the rear binding are both mounted adjustably and are both moved when there is a change of boot size. In such a mounting, snow and dirt may get in between the plate and the runner through the aperture provided for passage of the releasing lever. The ice which forms under the plate and the dirt may prevent adjustment.

The object of the invention is to remedy this drawback.

For this purpose, the mounting is such that, in the plate-lever assembly, at least one of these components is provided with a means for closing off said aperture, which closes off, at least approximately, said aperture at least in the position of use of the binding.

In principle, it is not necessary to close off the aperture in the released position, given that the releasing lever occupies this position only for short periods and under conditions such that the risk of snow or dirt getting in is extremely low.

The closure means may consist of a component which moves with the releasing lever or of a fixed component, such as one or two flexible lips or a brush.

The appended drawing illustrates, by way of example, two embodiments of the invention.

FIGS. 6A–6C are section views showing various closure devices for the window from the vantage points such as that shown by A—A of FIG. 1.

Figure 1:
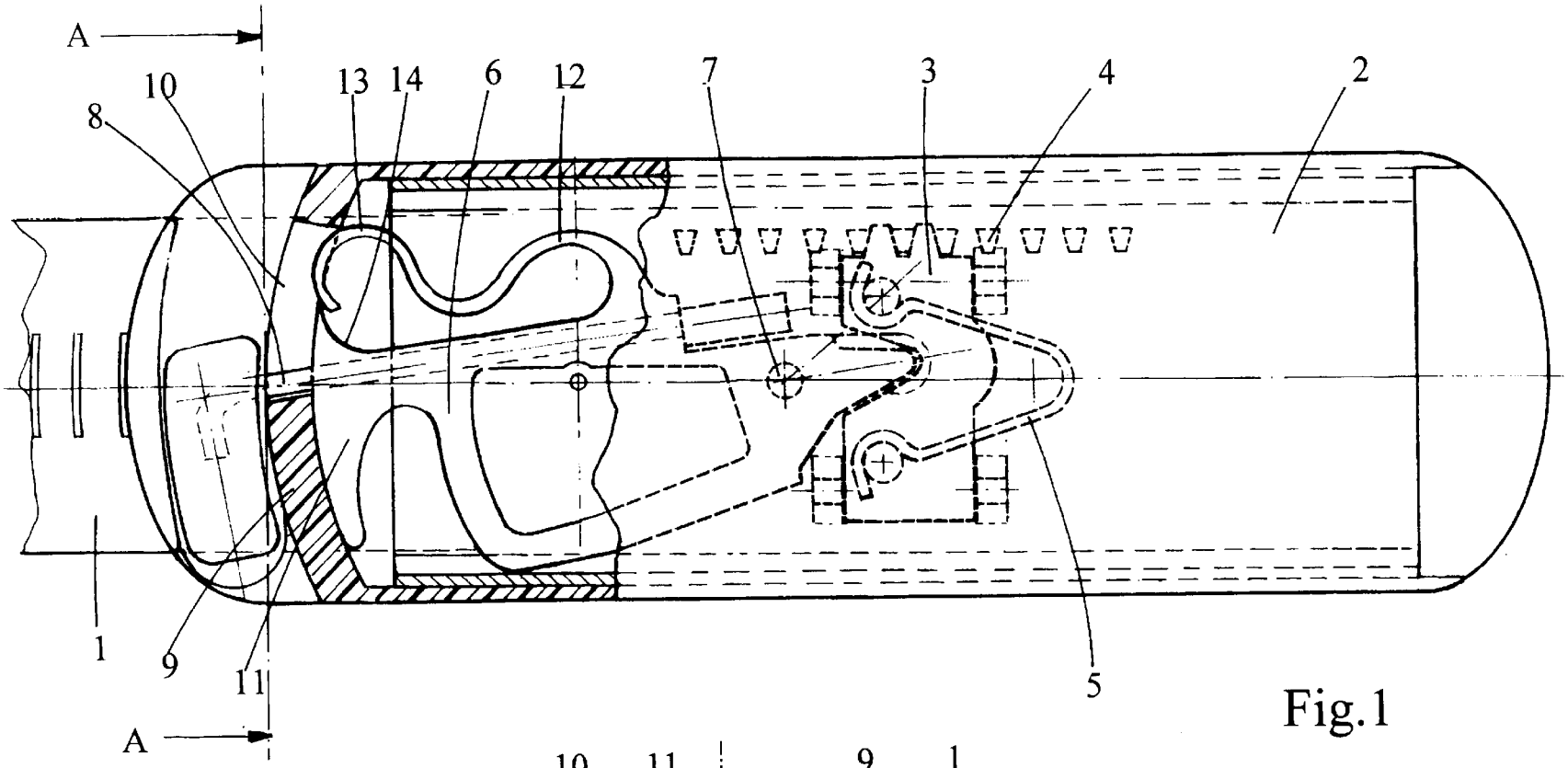
FIG. 1 illustrates a mounting, seen from above, with the plate partially cut away so as to show the releasing lever.
Figure 2:
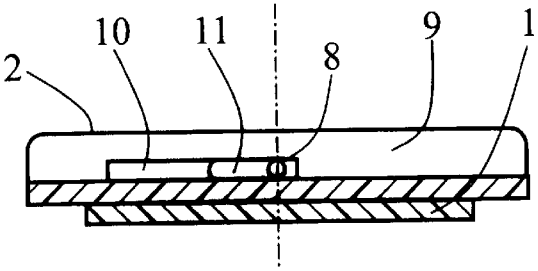
FIG. 2 is an end view of the same mounting in the direction A.

The mounting illustrated in FIGS. 1 and 2 comprises, fastened to a ski, a runner 1 on which a plate 2 is mounted, said plate being able to move along the runner 1 and being able to be locked on this runner by means of a latch 3 engaged in notches 4 of the runner 1 under the effect of a spring 5. The plate 2 can be released by means of a releasing lever 6 which is pivoted under the plate 2 about a pin 7. The lever 6 is furthermore provided with an actuating rod 8 which passes through a transverse wall 9 of the plate 2 via an aperture 10, allowing the rod 8 to move. The wall 9 is in the form of a circular arc, centered on the pin 7. Immediately behind the wall 9, the lever 6 has a circularly arcuate part 11 whose curvature matches the internal curvature of the wall 9 and extends on each side of the rod 8. In the rest position, this part 11 obstructs part of the aperture 10. The lever 6 furthermore has a flexible arm 12 of undulating shape terminating in a part 13 which curls round toward the part 11 of the lever and which, in the rest position, bears, on the one hand, against the end of the aperture 10 and, on the other hand, against the end of the part 11, entering the aperture 10 so as to obstruct that part of the aperture 10 which is not obstructed by the part 11 of the lever. The part 11 has a concavity 14 facing the terminal part 13 of the flexible arm.

When the lever is moved clockwise, in order to release the plate 2, the end 13 of the flexible arm 12 curls round in the concavity 14 of the lever, which then obstructs the rest of the aperture 10. In this case, the rest of the aperture 10 is also obstructed in the releasing position of the lever 11.

It should be possible to dispense with the flexible arm 12 by reducing the mechanical advantage of the lever 6. The width of the window 10 could be reduced in such a way that the enlarged part 11 is sufficient to close off the window.

Figure 3:
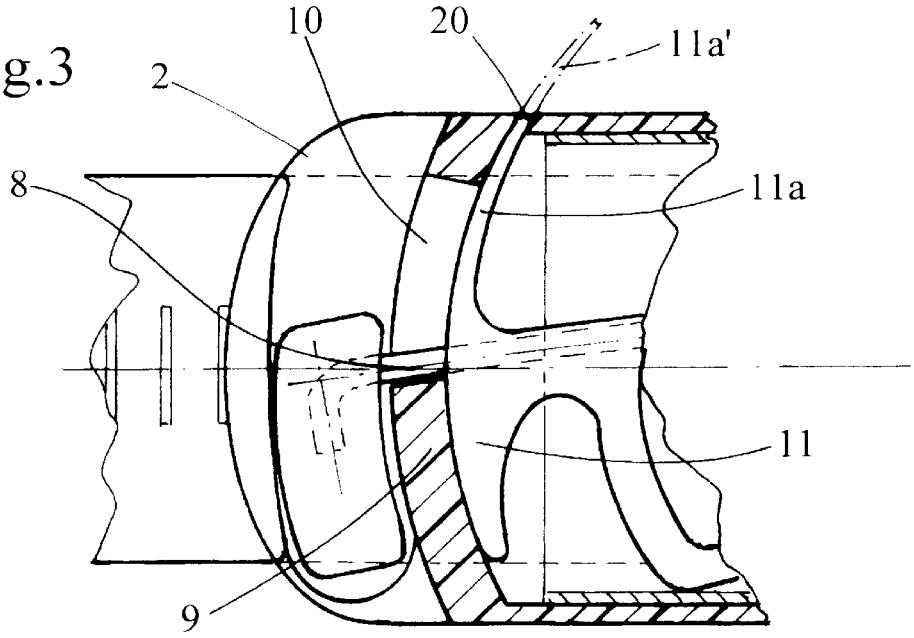
FIG. 3 illustrates an alternative form of the first embodiment.

Given that it is not necessary for the aperture 10 to be closed when the releasing lever is in the actuated releasing position, the aperture 10 could be closed by an excrescence on the lever, said excrescence passing through the side of the plate 2. FIG. 3 illustrates such an excrescence 11*a* passing through a hole 20.

The aperture 10 could also be closed off by a flexible component, for example a bellows 30 connecting the rod 8 to the opposite edge of the aperture 10.

Figure 4:
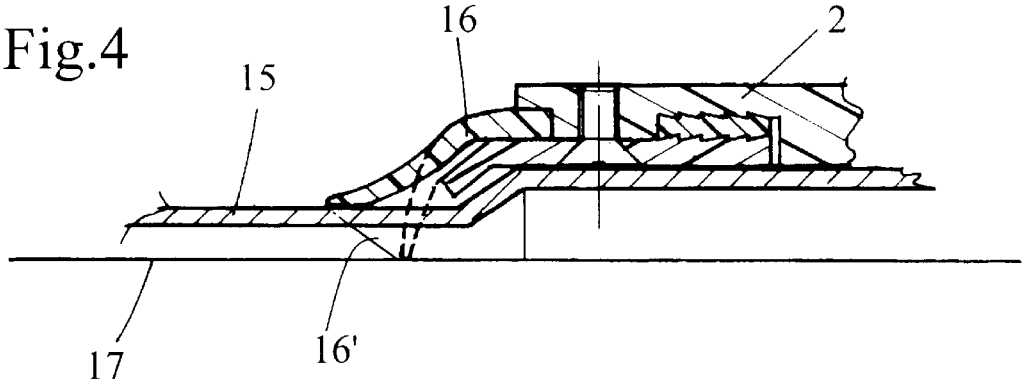
FIG. 4 is a partial view, in vertical section, of a second embodiment.
Figure 5:
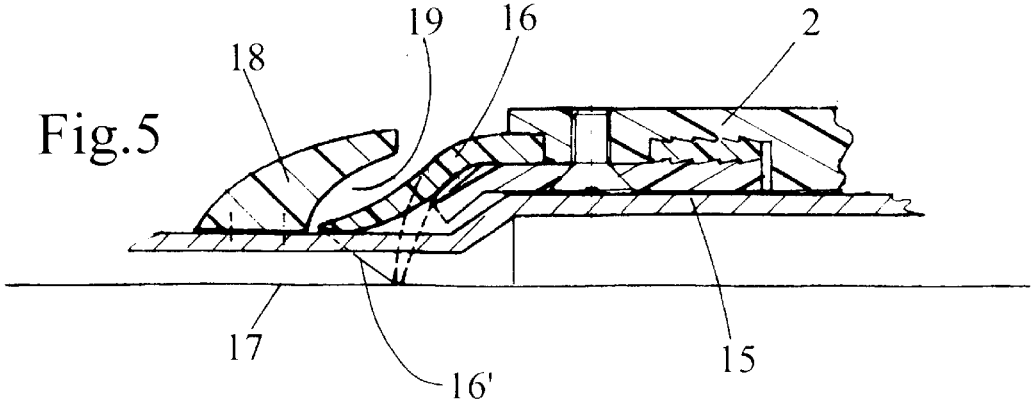
FIG. 5 illustrates an alternative form of this second embodiment.

In the second embodiment, illustrated in FIG. 4, the aperture through which the releasing lever 15 passes is closed by a flexible lip 16 having an edge 16' fastened to the end of the plate 2 and bearing on the ski 17. In the case of FIG. 1, the lip 16 could bear on a bearing surface of the plate 2.

Despite the flexibility of the lip 16, a gap is formed on each side of the lever 15. In order to remedy this drawback, it is possible to provide the lever 15 with a piece 18, as illustrated in FIG. 4, which piece serves both as a means for gripping onto the lever 15 and for covering that part of the lip 16 raised by the lever 15. For this purpose, the piece 18 has a groove 19 for passage of the lip 16.

Closure of the aperture could be improved by providing a second lip opposite the first, the lever passing between these two lips.

Instead of a lip, it is possible to use a brush 32 fastened to the front end of the plate 2.

Given that it is not necessary for the aperture 10 to be closed when the releasing lever is in the actuated releasing position, the aperture 10 could be closed by a piece pivoted to the lever and passing through the side of the plate 2 via a hole which can serve at the same time for guiding this piece. Thus, a kind of sliding door integral with the releasing lever is thus produced.

What is claimed is:

1. A longitudinally adjustable mounting for a ski binding which comprises a runner (1), fastened to the ski and having a row of notches (4) parallel to the axis of the runner, and a plate (2) slideably mounted on the runner and bearing a latch (3) engaged, under the action of a spring (5), in at least one notch of the runner so as to immobilize the plate on the runner, this plate being provided with a releasing lever (6) mounted so as to pivot, under the plate, about a pin (7) perpendicular to the plate, this releasing lever passing through the plate via an aperture (10) so as to have one end accessible for operating the lever, wherein, means is provided (11, 13; 16) for closing off said aperture (10) at least when the lever is in the position of use of the binding.

2. The mounting as claimed in claim 1, wherein said aperture (10) is an arcuate window made in a matching arcuate transverse wall (9) of the plate, the wall being centered on the pin and wherein the closure means consists of an arcuate rigid internal part (11) of the lever, and having a width such that the window is closed for all positions of the lever.

3. The mounting as claimed in claim 1, wherein said aperture is an arcuate window (10) made in a transverse wall (9) of the plate, the wall being centered on the pin and wherein the closure means consists of a matching arcuate rigid internal part (11) of the releasing lever, having a width such that the window (10) is partially closed by this part in the rest position of the releasing lever and of a flexible arm (12) of the releasing lever closing that part of the window which is not closed by the rigid part of the lever in the rest position of the releasing lever.

4. The mounting as claimed in claim 3, wherein the flexible part (12) of the releasing lever is a flexible arm, the end (13) of which curls round toward the rigid part (11) and bears permanently against thc end of the aperture (10) and against one end of the rigid part (11), this rigid part (11) having a concavity (14) facing said flexible arm, in such a way that said end (13) retracts and curls round against said concavity when the lever is moved toward the flexible arm.

5. The mounting as claimed in claim 1, wherein said aperture is an arcuate window made in a transverse, arcuate wall of the plate and wherein the closure means consists of a lateral, arcuate excrescence **(11*a*) on the releasing lever (6)**.

6. The mounting as claimed in claim 1, wherein said aperture is an arcuate window made in an arcuate transverse wall of the plate and wherein the closure means consists of a bellows connecting the releasing lever to the opposite end of said window.

7. The mounting as claimed in claim 1, wherein the closure means consists of at least one flexible lip (16) fastened to the front end of the plate (2) and bearing on the lever (15).

8. The mounting as claimed in claim 1, wherein the closure means is a brush fastened to the front end of the plate (2) and bearing on the lever (15).

* * * * *